United States Patent [19]

Porel

[11] Patent Number: 4,486,152

[45] Date of Patent: Dec. 4, 1984

[54] PUMP WITH SPRING LOADED VALVE

[75] Inventor: Louis-Claude Porel, Rambervillers, France

[73] Assignee: Hydro Rene Leduc, France

[21] Appl. No.: 209,220

[22] Filed: Nov. 21, 1980

[30] Foreign Application Priority Data

Nov. 26, 1979 [FR] France ..... 79 29037
Apr. 30, 1980 [FR] France ..... 80 09780

[51] Int. Cl.[3] ..... F04B 49/02; F04B 39/08

[52] U.S. Cl. ..... 417/270; 417/298; 417/510; 417/515

[58] Field of Search ..... 417/269, 510, 515; 91/503, 476, 480

[56] References Cited

U.S. PATENT DOCUMENTS

| | | | |
|---|---|---|---|
| 861,213 | 7/1907 | Homersham | 417/443 |
| 1,316,794 | 9/1919 | Holveck | 417/298 |
| 1,894,869 | 1/1933 | Holveck | 417/269 |
| 2,001,336 | 5/1935 | Vago et al. | 417/506 |
| 2,131,857 | 10/1938 | Lauret | 417/270 |
| 2,504,041 | 4/1950 | Orshansky, Jr. | 417/503 |
| 2,923,251 | 2/1960 | De Lancy | 91/480 |
| 3,050,005 | 8/1962 | Pschunder | 91/480 |
| 3,118,390 | 1/1964 | Kinsley | 417/510 |
| 3,621,759 | 2/1970 | Cousino | 91/481 |
| 3,981,630 | 9/1976 | Le duc | 417/269 |

FOREIGN PATENT DOCUMENTS

| | | | |
|---|---|---|---|
| 989095 | 9/1951 | France | 417/270 |
| 2449210 | 12/1980 | France | 417/269 |
| 581735 | 10/1946 | United Kingdom | 417/269 |

*Primary Examiner*—William L. Freeh
*Attorney, Agent, or Firm*—Darby & Darby

[57] ABSTRACT

A hydraulic pump having spring loaded valves utilizes a spring providing a constant spring force and a spring providing a varying spring force. The varying spring force depending upon the position of the pump piston. The pump suction valve opens after a variable delay relative to the beginning of the piston suction phase when the pressure prevailing in the pump's dead chamber falls below a predetermined value. Abrupt decompression to the dead chamber is therefore avoided resulting in reduced energy consumption and noise level.

8 Claims, 11 Drawing Figures

PUMP WITH SPRING LOADED VALVE

FIELD OF THE INVENTION

The present invention relates to an improvement to hydraulic pumps provided with valves on the suction and delivery sides. The suction valves are either driven or self-acting. In the latter case, the spring maintaining them in position is a source of many problems:

If it exerts a small effort, the valve opens easily when the inner pressure conditions allow it to do so, but it is only capable of operating at a low speed; indeed, at high speeds, its closing time is too long and moreover it oftens happens that it rebounds;

If it exerts the effort which is necessary for operating at the usual speeds, the spring used for keeping it in position prevents generally the inlet valve to open under the effect of the depression created by the pump, which is therefore in the impossibility of being primed—at least without a significant pressurization of the suction.

BACKGROUND OF THE INVENTION

This is why quick operating pumps have generally sucking devices—notably valves—controlled by the movement of the pump. In such equipments, the position of each suction device—particularly of each valve—depends only on the position of the corresponding piston and of the phase in which it is. Such devices present the serious disadvantage of causing, cylinder by cylinder, the opening of the suction device at the beginning of the suction stroke of the corresponding piston, viz. at a moment where the dead chamber is still at a pressure which is very close to the delivery pressure of the pump. Said dead chamber having usually a rather important volume and the compressibility of the conveyed fluids being far from negligible, the energy contained in the dead chamber is important and increases with the operating pressure of the pump. The communication established between the dead chamber and the suction causes therefore an abrupt decompression of said dead chamber, this representing not only a loss of energy but increasing also substantially the operating noise of the pump.

Thus, for example, if one considers a hydraulic pump operating at 400 bars with a hydraulic liquid such as is defined in French Standard AIR 3520, one may consider that at the usual operating temperature of 50° C., the compressibility coefficient of the fluid will be of 1/15,000. A theoretical calculation shows that if the dead chamber has a volume of 25 $cm^3$ and the cylinder content is of 10 $cm^3$, a rotation of the skew plate over about 36° will be needed (over a stroke of 180° for establishing the pressure) for ensuring the rising of the pressure to 400 bars; and after the end of the delivery stroke, a rotation of about 30° will be needed. As the compressibility coefficient may vary from 1/22,000 at 50° C. to 1/9,500 at 150° C., and as microscopic air bubbles may be present in the delivered liquid, it may happen in practice that a rotation of the pump shaft over 50° is necessary for decompressing the piston chamber.

Attempts have already been made to remedy these disadvantages by foreseeing means for communicating the suction with the dead chamber, comprising a delay providing a relative decompression of the dead chamber prior to its being set in communication with the suction.

This is the case particularly with skew plate pumps which do not comprise valves but a lunule engraved on the plate, the communication being established through the piston. It is then possible to place the beginning of the lunule so that the communication is established only after of a time of decompression. But for the high pressures and the low flow rates—conditions existing for example with variable cylinder pumps—this would lead to reducing the lunule excessively, the rotation needed for the decompression being in the neighborhood of 180°; moreover, for the high flow rates obtained, for reasons of compactness, through a large stroke of the piston, the passage cross-section in each piston is generally not sufficient, and this solution becomes therefore impracticable.

OBJECTS AND SUMMARY OF THE INVENTION

The object of the present invention is a volumetric pump with valves on the suction side, avoiding the disadvantages just mentioned.

According to the invention, there is associated to each of the pistons a suction valve, returned to a closed position by a spring and urged back towards the opened position by an opposite or counter-effort which is a function of the position of the piston and the phase in which it is, said counter-effort reaching, during part at least of the suction phase, a value higher than the return effort of the spring which urges the valve back to its closed position.

Thus, as soon as the retraction movement of the piston allows the dead chamber to be sufficiently decompressed, the valve may open under the effect of the counter-effort.

It should be noted that due to this decompression, through the movement of the piston, there is of course a restitution of energy on the driving shaft of the pump.

According to an embodiment of the invention, a counter-effort is obtained by means of a counter-spring compressed by a means of some sort, such as a cam, as a function of the position of the piston and during the suction phase.

The relative characteristics of the return spring, the counter-spring and the cam have to be determined as a function of the residual pressure beyond which one wishes the valve to open.

Thus is obtained a hydraulic pump having a valve on the suction side, the suction valve opening after a variable delay relative to the beginning of the piston suction phase, said delay being automatically adapted to the operating conditions of the pump (pressure and flow rate), so that the suction opens when the pressure prevailing in the dead chamber, measured relative to the suction pressure, falls below a predetermined value which will be, preferably, lower than 15 bars, and of the order of 3 to 5 bars.

Moreover, the present invention allows reversing the rotation direction of the pump having a skew plate, which, for the skew plate pumps having a lunule and of known type, needs an intervention for reversing the position of said lunule.

The invention is applicable to hydraulic pumps of various types, and having various types of valves.

BRIEF DESCRIPTION OF THE DRAWINGS

A description will now be given hereafter, with reference to the accompanying drawings in which.

DETAILED DESCRIPTION OF THE EMBODIMENTS

Referring to said FIGURES, one sees that the pump according to the invention, of the volumetric type, comprises pistons 1, compressing the fluid in two chambers 2 to which are associated suction ducts 3 and delivery ducts 4.

Figure 1:
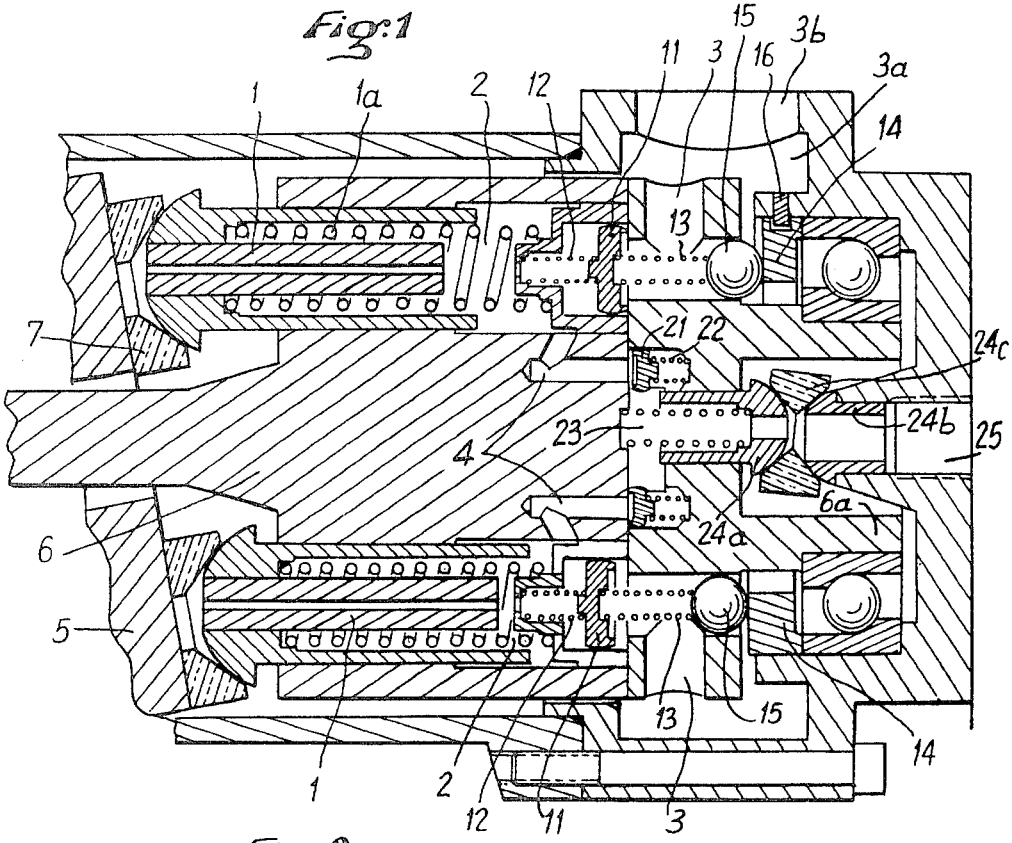
FIG. 1 is a shematic cross-sectional view of its application to a pump having a fixed skew plate and a rotating barrel.

FIG. 1 shows in axial cross-section a pump with a fixed skew plate 5, the pistons 1 being mounted on a rotating barrel 6 urged pushed back by springs 1*a* against the plate 5, with the interposition of sliding studs 7.

In the example shown in FIG. 1, a breech 6*a* is fixed to the rotating barrels. In said breech 6*a* are placed: suction ducts 3, in free communication with volume 3*a* in which emerges the inlet opening 3*b* of the liquid, said openings 3*a* communicating with the chambers 2 of pistons 1 through suction valves 11, each urged back to their closed position by a return spring 12. At the base of chambers 2 and slightly upstream of the feeding valves 11 are mounted delivery ducts 4 closed by valves 21, urged back by springs 22, said valves communicating with a central chamber 23 which, through a double central piston 24*a* and 24*b* between which is placed a stud 24*c*, communicates with the outlet opening of the pump 25. The assembly 24*a*, 24*b* and 24*c* acts as a rotating connection.

Figure 2:
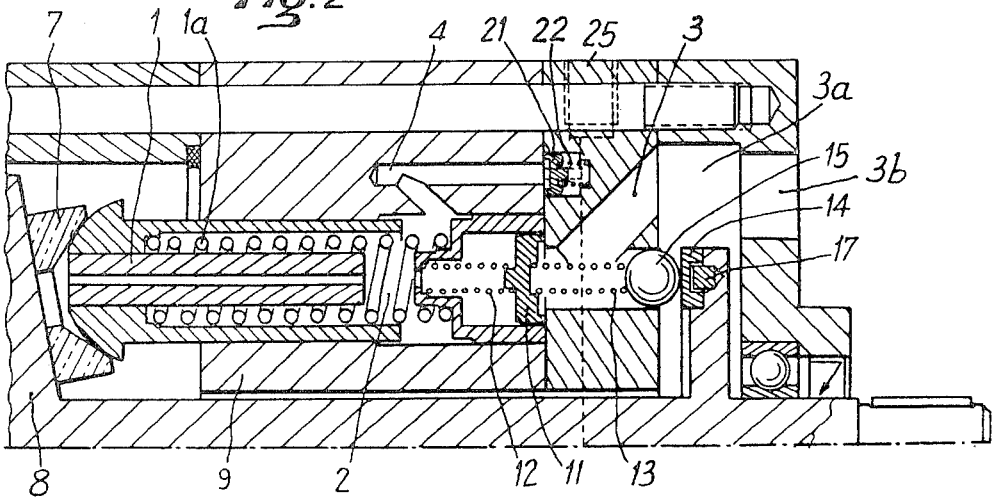
FIG. 2 is a schematic cross-sectional view of its application to a pump having a rotating skew plate and fixed pistons.

FIG. 2 is a partial axial cross-sectional view of a pump having a rotating skew plate 8, the pistons 1 being mounted on a fixed body 9 and biased back by the springs 1*a* against the plate 8, with the interposition of sliding studs 7.

In the example shown in FIG. 2, the parts designated by the same reference numerals as in FIG. 1 are identical or similar.

Figure 4:
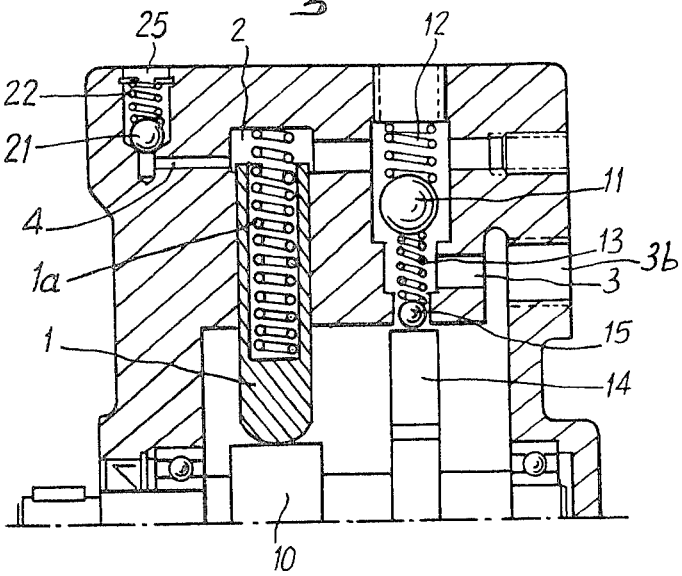
FIG. 4 is a schematic cross-sectional illustration of the adaptation of the invention to a pump with radial pistons.

FIG. 4 shows in a partial axial cross-sectional view a pump having radial pistons operated by the cam 10, mounted on the pump shaft 21 and urged back by springs 1*a*.

In the example shown in FIG. 4, the parts designated by the same reference numerals as in FIG. 1 and 2 are identical or similar.

According to the invention, each valve 11 is not only subjected to the effort applied by its return spring 12, but also subjected to a couter-effort applied in the reverse direction, said effort being variable as the pump cycle develops, so that said effort is higher than the effort of the return spring 12 during part at least of the suction phase. In the examples shown, said effort is applied by a spring 13, compressed by the cam 14, the profile of which is designed as a function of the spring 13 characteristics, so that the counter-effort meets the aforementioned conditions.

Preferably, a ball 15 is interposed between the spring 13 and the cam 14.

Preferably, the cam 14 and the spring 13 are designed so that the counter-effort is higher than the return effort during the almost totality of the suction stroke of the piston.

Preferably, the cam 14 and the spring 13 are designed so that during the suction phase, the counter-effort exceeds the return effort by a quantity capable of balancing an overpressure in the dead chamber lower than 15 bars, and preferably of the order of 3 to 5 bars.

The operation is the following:

During the compression phase, the valve 11 is applied against its seat in a closed condition by the pressure of the liquid flowing in duct 4, through the valve 21, the rotating connection 24, and the opening 25. The spring 12 is calculated so as to be strong enough for providing a quick return of the valve to its closed position at the beginning of the compression phase and to avoid any inopportune rebound when the pump operates at a high speed.

During the suction phase, the cam 14 urges back the ball 15 and compresses thereby the spring 13, which exerts then on the valve 11 a counter-effort which is higher than that of spring 12. As the piston 1 is retracted within chamber 2, the residual pressure remaining in said chamber 2 at the end of the compression phase decreases: as soon as it falls below a value corresponding to the difference of the opposite efforts applied by the spring 11 and the spring 13, which are thus tensioned by the cam 14, the valve 11 opens.

The result is on the one hand that an abrupt decompression such as a decompression from 400 bars to zero is avoided, said abrupt decompression being replaced by a weak decompression of the order from 3 to 5 bars to zero, which is practically negligible from the energetic point of view as well as from the sound level point of view.

On the other hand, one will observe that with the device of the invention, the opening of the suction valve is produced when the overpressure in the dead chamber has fallen below a predetermined value, which occurs at a variable moment according to the operating conditions of the pump: thus, for high flow rates and low pressures, this moment will occur with a small delay relative to the beginning of the suction phase, whereas for high pressures and small flow rates, this delay will eventually be in the neighbourhood of 180°.

In other words, the delay at the opening of the suction is automatically adapted to the operating conditions of the pump.

Figure 6:
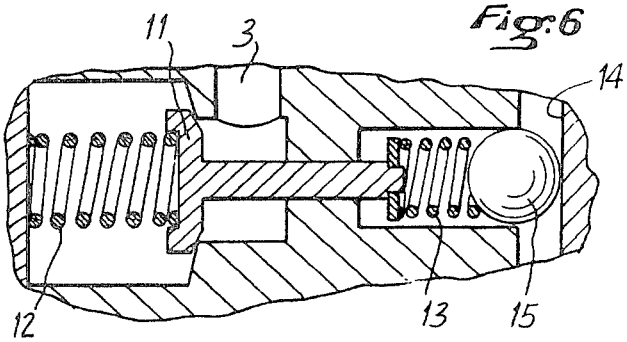
In FIG. 6, the valve is of the cone on a cone contact type.
Figure 7:
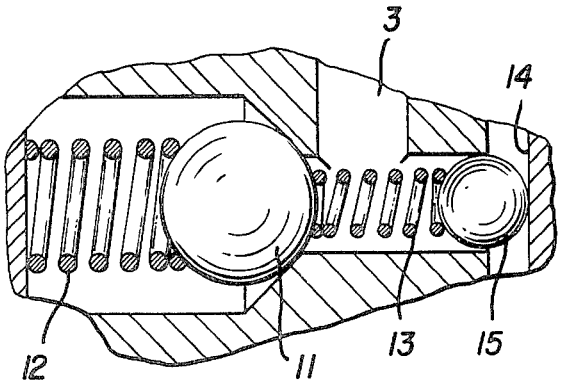
In FIG. 7, the valve is of the ball type.
Figure 8:
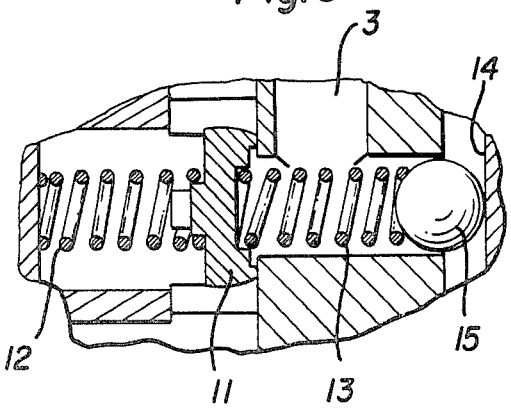
In FIG. 8, the valve is of the plane on a plane contact type.
Figure 9:
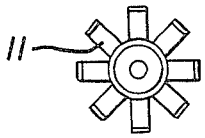
FIG. 9 shows the guide of the suction valve 11 of FIG. 1 and 2.

FIG. 6, 7 and 8 show that the suction pump may be made in various ways without having an influence on the nature of the invention. In FIG. 6, the valve is of the cone on cone contact type, in FIG. 7, of the ball type, and in FIG. 8 of the plane on plane contact type.

In the various FIGURES, the spring 13 is compressed by the cam 14 through a ball 15. Other means may be used, for example a shoe sliding on the cam. The ball 15 is only a means within the knowledge of those skilled in the art for transmitting to spring 13 the action of cam 14.

Likewise, the spring 13 and the cam 14 may be replaced by any equivalent means permetting applying to the valve 11 a counter-effort having the specified characteristics. Particularly, one may use a pneumatic or oleo-pneumatic means. However, the cam and spring system is preferred for its simplicity.

Figure 3:
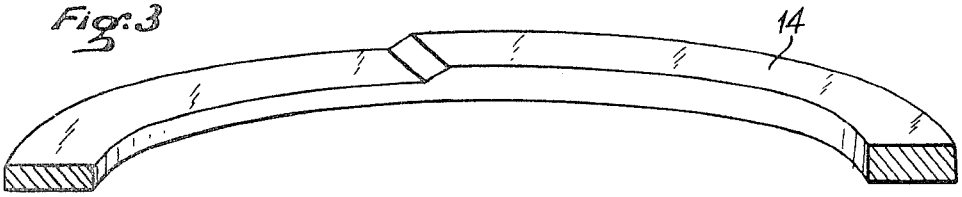
FIG. 3 is a perspective schematic view illustrating a cam profile adapted to the pumps of FIG. 1 and 2.

FIG. 3 illustrates the cam profile convenient for the case of FIG. 1 and 2. The raised portion of the cam, corresponding to the counter-effort, occupies at least a portion of the area corresponding to the suction phase and the curve of the raised portion may be established in various ways.

In the example shown, this raised portion is formed by a constant height section, but the invention is not limited to this disposition. In fact, one can provide a cam having a shape such that the tensening of the spring 13 by the cam 14 is progressive.

In the case of FIG. 1, the cam 14 is fixed and keyed in an angular position relative to the pump body 20 by member 16.

In the case of FIG. 2, the cam 14 rotates with the plate. It is keyed in an angular position by member 17.

Figure 5:
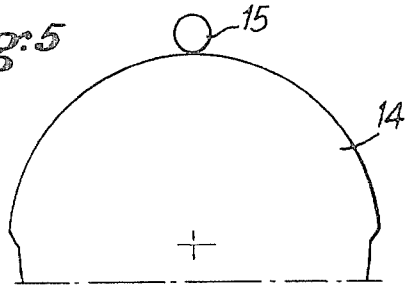
FIG. 5 illustrates a cam profile adapted to the pump of FIG. 4, FIG. 6, 7 and 8 illustrate alternative valves.

In the case of FIG. 4, the cam 14 may be carried by shaft 21 which supports the cam 10 operating the pistons, its profile being shown in FIG. 5.

To reverse the rotation direction of a pump, it is necessary to reverse the delivery and compression phases. In the case where the delivery takes place across a suction lunule engraved on the face of the skew plate, a plate mounted on that face is rotatable so as to be displaced over an 180° arc. This arrangement has been described in French Patent applications 77.18715 and 80.03933. In the case of the pump such as that described in FIG. 2, the cam, controlling the counter-effort acting on the suction valves, is connected to the skew plate by means which allow it to be displaced over 180° relative to the same.

Figure 10:
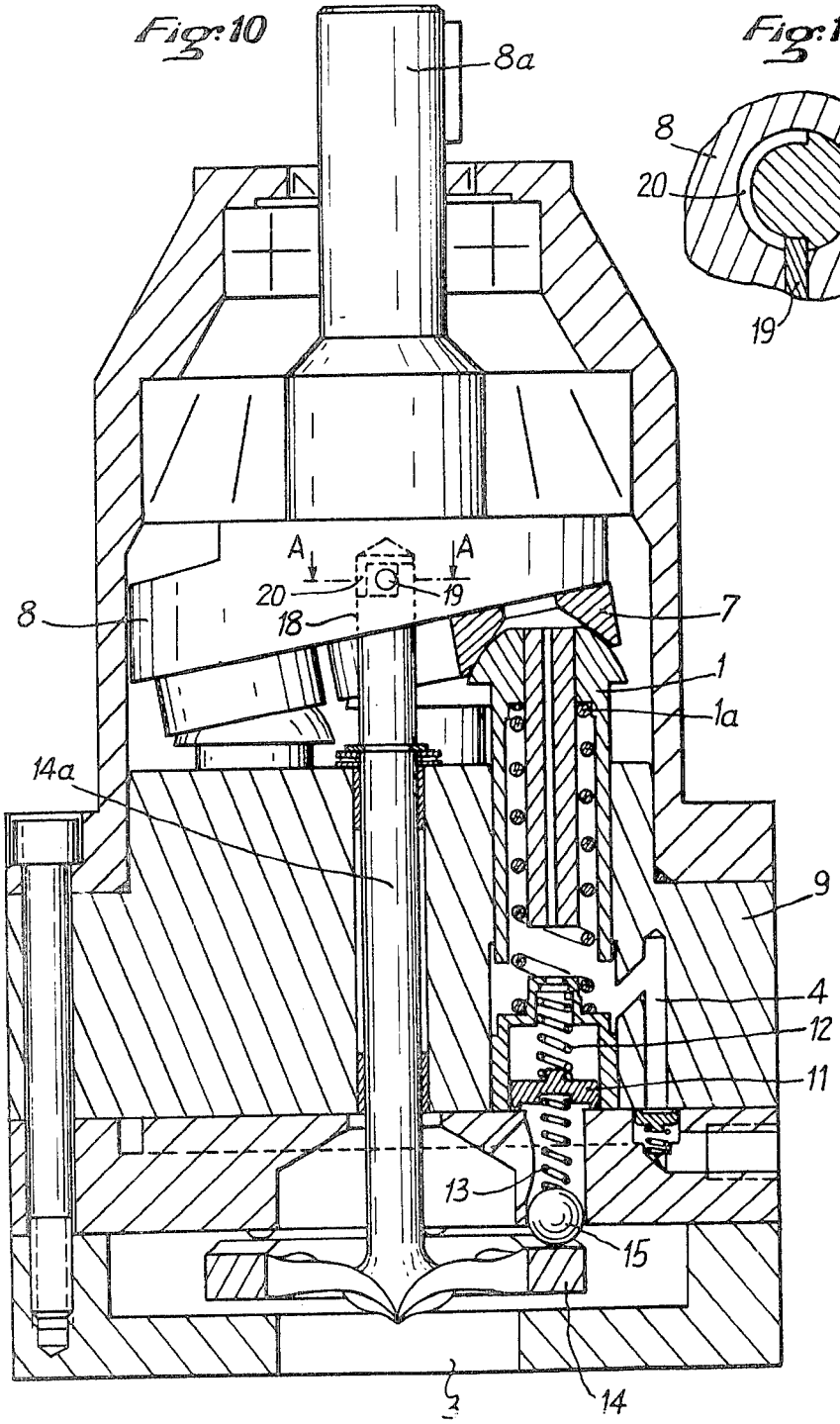
FIG. 10 is a longitudinal cross-sectional view of an alternative of the pump shown in FIG. 2.
Figure 11:
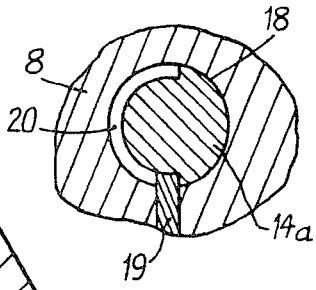
FIG. 11 is a view at a larger scale of a detail of FIG. 10.

In the example described in FIG. 2, the cam (14) is rigidly connected to the skew plate (8), however, in the example shown in FIGS. 10 and 11, the cam (14) is rigidly connected to a shaft **(14*a*), coaxial with the shaft (8*a*), which is pivotally engaged into a bore (18), formed in the skew plate (8). Inside the bore (18) stud (19) protrudes and extends into a semi-circular shoulder or groove (20) formed on the end of the shaft (14*a*) over an arc of 180° plus twice the half thickness of the stud (19). The shaft (14*a*)** is thus able to occupy two positions at 180° from one another.

When the shaft **(8*a*) turns in one direction, the skew plate (8) turns without driving the shaft (14*a*) until the stud (19) comes into abutement against one of the ends of the semi-circular shoulder or groove (20) and from that moment, the shaft (14*a*) is positively driven by the skew plate, and thus the cam (14). When the shaft (8*a*) is driven in the opposite direction, the skew plate (8) rotates 180° before the stud (19) comes to abut against the second end of the shoulder (2) so that the cam (14)** is displaced over 180° relative to its previous position, which reverses the opening and closing cycle of the valves.

I claim:

1. A hydraulic pump comprising:

at least one moveable piston means;

means for moving said piston means;

suction valve means in communication with said piston for permitting flow of hydraulic fluid into said pump during a suction phase of said piston movement;

delivery valve means in communication with each of said piston means, for permitting the flow of hydraulic fluid out of said pump during a compression phase of said piston movement;

first spring coupled to said suction valve for providing a first substantially constant force urging said suction valve closed;

a moveable cam;

shaft means coupled to said piston moving means and coupled to said cam for moving said cam in synchronism with the cycle of said pump;

second spring bearing against said cam and opposing said first spring coupled to said suction valve for providing in a direction opposite to said first force a counterforce from said second spring varying in synchronism with said pump cycle, said counterforce being smaller than said first force during said pump delivery phase and higher than said first force during at least part of said suction phase, said valve opening only when pump residual pressure has fallen below a predetermined value.

2. The pump according to claim 1, comprising a plurality of pistons placed radially relative to a pump shaft and bearing against a cam which is rigidly connected to said shaft, said cam which acts on said springs being rigidly coupled to said shaft.

3. The pump according to claim 1, further comprising a plurality of pistons and associated first and second springs parallel to an axis of the said pump and disposed in a rotating barrel, said pistons bearing against an inclined face of a non rotating skew plate, each of said springs associated with a suction valve, bearing against said circular cam, which is fixed relative to the pump body.

4. The pump according to claim 1, comprised of a plurality of pistons parallel to an axis of said pump, and bearing against an inclined face or a rotating skew plate and further including a body in which said pistons and said valves are fixed, said cam (14) being circular and rigidly connected to a shaft carrying said skew plate.

5. The pump according to claim 4 further comprising: a shaft carrying said cam; and means for coupling said shaft to said skew plate, said coupling means alluring said skew plate to displace over 180° in its direction of rotation.

6. The pump according to claim 5, wherein said shaft is pivotally engaged into a bore, coaxial with said plate, inside of which protrudes a stud extending into a semi-circular groove or shoulder formed in said shaft said stud coming in abutement against one or the other of the ends of said groove or shoulder (20) along the rotation direction of said skew plate, said cam being displaced over 180° in the rotation direction of said skew plate.

7. The pump according to claims 1, 3, 4, 6 or 2, wherein said cam and said springs urge said suction valve open when said liquid residual pressure is lower than 15 bars.

8. The pump according to claim 7, wherein each valve opens at a residual pressure in the range of 3 to 5 bars.

* * * * *